US008123185B2

(12) United States Patent
Winig et al.

(10) Patent No.: US 8,123,185 B2
(45) Date of Patent: Feb. 28, 2012

(54) BRACKET RELEASE MECHANISM

(75) Inventors: Alan Winig, Wynnewood, PA (US); Richard Winig, Villanova, PA (US); James Eldon, Barto, PA (US)

(73) Assignee: SS3 Storage Systems, L.L.C., Wilmington, DE (US)

( * ) Notice: Subject to any disclaimer, the term of this patent is extended or adjusted under 35 U.S.C. 154(b) by 192 days.

(21) Appl. No.: 12/408,809

(22) Filed: Mar. 23, 2009

(65) Prior Publication Data

US 2009/0236482 A1 Sep. 24, 2009

Related U.S. Application Data

(60) Provisional application No. 61/038,901, filed on Mar. 24, 2008.

(51) Int. Cl.

| | |
|---|---|
| ***A47G 29/02*** | (2006.01) |
| ***E04G 3/08*** | (2006.01) |
| ***E06B 7/28*** | (2006.01) |

(52) U.S. Cl. ..... 248/250; 248/220.43; 248/221.11; 248/235; 211/90.01

(58) Field of Classification Search ..... 211/90.01, 211/134, 90.02, 88.01, 70.6; 248/220.43, 248/221.11, 220.41, 222.11, 222.12, 222.51, 248/250, 245, 235

See application file for complete search history.

(56) References Cited

U.S. PATENT DOCUMENTS

| | | | |
|---|---|---|---|
| D373,949 | S | 9/1996 | Eldon, III et al. |
| D374,366 | S | 10/1996 | Eldon, III et al. |
| 5,593,045 | A | 1/1997 | Eldon, III et al. |
| D406,714 | S | 3/1999 | Eldon, III et al. |
| D469,004 | S | 1/2003 | Winig et al. |
| 6,581,788 | B1 | 6/2003 | Winig et al. |
| D478,499 | S | 8/2003 | Winig et al. |
| D478,500 | S | 8/2003 | Winig et al. |
| D478,805 | S | 8/2003 | Winig et al. |
| D481,920 | S | 11/2003 | Winig et al. |
| D482,255 | S | 11/2003 | Winig et al. |
| 6,702,128 | B2 | 3/2004 | Winig et al. |
| D491,286 | S | 6/2004 | Winig et al. |
| D491,287 | S | 6/2004 | Winig et al. |
| D491,449 | S | 6/2004 | Winig et al. |
| D494,035 | S | 8/2004 | Winig et al. |
| D494,036 | S | 8/2004 | Winig et al. |
| D494,436 | S | 8/2004 | Winig et al. |
| D494,451 | S | 8/2004 | Winig et al. |
| D494,457 | S | 8/2004 | Winig et al. |
| D495,067 | S | 8/2004 | Winig et al. |
| D495,243 | S | 8/2004 | Winig et al. |
| D495,944 | S | 9/2004 | Winig et al. |
| D496,844 | S | 10/2004 | Winig et al. |
| D497,788 | S | 11/2004 | Winig et al. |
| D498,005 | S | 11/2004 | Winig et al. |
| D498,372 | S | 11/2004 | Winig et al. |

(Continued)

*Primary Examiner* — Amy J Sterling
(74) *Attorney, Agent, or Firm* — Duane Morris LLP

(57) ABSTRACT

A storage system including a shelf-bracket and a panel having a plurality of spaced perforations. The shelf-bracket includes a substantially circumferential flange and a receptacle portion for receiving an end edges of a shelf. An upper panel-catch and a lower panel-catch project outwardly from a side of the circumferential flange in aligned spaced relation to one another. Each of the upper panel-catch and the lower panel-catch have a lock-tab projecting toward an outer surface of the circumferential flange. A pull-release latch is provided that includes a cantilevered beam having a tab projecting outwardly from a free end so as to engage a portion of a perforated panel adjacent to the lower panel-catch, with a trigger disposed within a void defined by a recessed wall.

16 Claims, 11 Drawing Sheets

U.S. PATENT DOCUMENTS

| | | | |
|---|---|---|---|
| D498,634 | S | 11/2004 | Winig et al. |
| D499,005 | S | 11/2004 | Winig et al. |
| D499,195 | S | 11/2004 | Winig et al. |
| D499,626 | S | 12/2004 | Winig et al. |
| D501,125 | S | 1/2005 | Winig et al. |
| D502,638 | S | 3/2005 | Winig et al. |
| D508,199 | S | 8/2005 | Winig et al. |
| 6,935,518 | B2 | 8/2005 | Winig et al. |
| D509,393 | S | 9/2005 | Winig et al. |
| D513,968 | S | 1/2006 | Winig et al. |
| D519,303 | S | 4/2006 | Winig et al. |
| 7,353,957 | B2 | 4/2008 | Winig et al. |
| 7,354,024 | B2 | 4/2008 | Winig et al. |
| D577,940 | S | 10/2008 | Winig et al. |
| D577,941 | S | 10/2008 | Winig et al. |
| D577,942 | S | 10/2008 | Winig et al. |
| D579,705 | S | 11/2008 | Winig et al. |
| D587,934 | S | 3/2009 | Winig et al. |

BRACKET RELEASE MECHANISM

This application claims priority from, and the benefit of U.S. provisional patent application Ser. No. 61/038,901, filed Mar. 24, 2008, entitled BRACKET RELEASE MECHANISM, which is incorporated herein by reference.

FIELD OF THE INVENTION

The present invention relates to storage and organizational systems and devices, and more particularly to storage and organizational systems and devices for storing home and garden tools or the like.

BACKGROUND OF THE INVENTION

In modern American suburbia, the garage has become the storage receptacle for a myriad of items that are necessary for work and recreation. The need for this storage space has become so acute that many suburban dwellings contain a 3-car garage even though the occupants own only two vehicles. Although, in many instances a recreational vehicle or boat occupies the third bay; in most cases, that extra space is utilized for storage and as a work area. Items such as sports equipment, gardening implements, and work shop related items, e.g., screwdrivers, hammers, wrenches, hand and power tools, and other implements for home, vehicle, or garden repair and maintenance are generally stored in the garage.

There are a number of systems for storing relatively small and lightweight articles known in the art. For example, pegboard or perforated panel systems are known for hanging articles in a vertical or horizontal orientation using pegboard hooks that are removably attached to a perforated panel. Shelving may also be provided on pegboards using the same or similar structures for securing and supporting the shelf to the pegboard. Prior art perforated panel systems (known as "pegboards") typically comprise a pressed composite board material with regularly spaced circular perforations into which hooks may be inserted for the storage or display of tools, instruments, and other articles. Changing the locations of the stored articles requires that the hooks or shelf-supports be removed completely from their respective supporting holes in the pegboard, and then reinserted into other holes. After a period of use, the holes tend to become worn and enlarged, and eventually become unable to retain the hooks. Also, the hooks are easily misplaced or lost. These pegboard systems are also aesthetically unattractive, especially after many years of use.

A wide variety of useful fasteners for holding items to walls are also well known in the art. When attaching items to a perforated wall or pegboard, however, the available fasteners are much fewer in number, and those that are available have many severe drawbacks. Those who use pegboards are also familiar with the frustration and irritation associated with an insecure hook. Such fasteners often pull off the pegboard and get lost or damaged, especially when only one or two items are held. The typical pegboard fastener is a straight single or double bar, usually extending from about two inches to about six inches from the pegboard. A pegboard fastener of this type usually has a pair of bent rod-like offset hooked portions at its top. These offset hooked portions are inserted into horizontally adjacent holes, by a pivoting action, to situate the top tip of the hooked portions behind the wallboard while allowing the lower part of the fastener to rest against the front surface of the wallboard.

While the use of a pair of hooked portions may inhibit rotation of the pegboard fastener, it does not avoid the frustration experienced when the pegboard fastener itself is pulled off the pegboard along with the item being removed. Those who encounter such fasteners or holders for hanging items experience frustration and irritation when attempting to remove the item from the fastener, since the bottom portion of the fastener is easily pulled away from the wall surface, i.e., there is no provision for fixing it to the pegboard. Additional examples of prior art storage systems and fasteners for the same may be found in U.S. Pat. Nos. D587,934; D579,705; D577,942; D577,941; D577,940; 7,354,024; 7,353,957; D519,303; D513,968 D509,393; 6,935,518; D508,199; D502,638; D501,125; D499,626; D499,195; D499,005; D498,634; D498,372; D498,005; D497,788; D496,844; D495,944; D495,243; D495,067; D494,457; D494,451; D494,436; D494,036; D494,035; D491,449; D491,287; D491,286; 6,702,128; D482,255; D481,920; D478,805; D478,500; D478,499; 6,581,788; D469,004; D406,714; 5,593,045; D374,366; and D373,949, which patents are hereby incorporated herein by reference.

Therefore, it would be advantageous to have a storage system which allowed ease of accessibility to tools, such as gardening implements, while maximizing the use of garage space, in an aesthetically satisfying manner. It would also be advantageous to have an item holder, e.g., a shelf-bracket suitable for use with this storage system that could be mounted directly to a perforated panel portion of the storage system, thereby allowing effective use of available space while facilitating easy removal of the item holder.

SUMMARY OF THE INVENTION

The present invention provides a shelf-bracket to be supported upon a panel having a plurality of spaced perforations. The shelf-bracket includes a substantially circumferential flange and a receptacle portion for receiving an end edges of a shelf. An upper panel-catch and a lower panel-catch project outwardly from a side of the circumferential flange in aligned spaced relation to one another. Each of the upper panel-catch and the lower panel-catch have a lock-tab projecting toward an outer surface of the circumferential flange. A pull-release latch is provided that includes a cantilevered beam having a tab projecting outwardly from a free end so as to engage a portion of a perforated panel adjacent to the lower panel-catch, with a trigger disposed within a void defined by a recessed wall.

In another embodiment of the invention, a storage system is provided that includes a panel having a plurality of spaced perforation and at least one shelf-bracket to be supported upon the panel. The at least one shelf-bracket includes a substantially circumferential flange and a receptacle portion for receiving an end edges of a shelf. An upper panel-catch and a lower panel-catch project outwardly from a side of the circumferential flange in aligned spaced relation to one another. Each of the upper panel-catch and the lower panel-catch have a lock-tab projecting toward an outer surface of the circumferential flange. A pull-release latch is also included that has a cantilevered beam including a tab projecting outwardly from a free end so as to engage a portion of the perforated panel adjacent to the lower panel-catch, and a trigger disposed within a void defined by a recessed wall.

In a further embodiment of the invention, a shelf-bracket is provided that is suitable for being supported upon a panel having a plurality of spaced perforations. The shelf-bracket includes a central wall having a receptacle portion for receiving an end edge of a shelf. An upper panel-catch and a lower panel-catch are provided on the shelf-bracket that project outwardly from an edge of the wall in aligned spaced relation to one another, each of the upper panel-catch and the lower panel-catch having a lock-tab projecting toward an outer edge of the wall. Also, a socket is defined adjacent to the lower panel-catch by a recessed portion of the wall. A modular pull-release latch positioned within the socket. The modular pull-release latch includes a cantilevered beam having a tab projecting outwardly from a free end so as to engage a portion of the perforated panel adjacent to the lower panel-catch. A trigger is disposed within a void defined by the recessed portion of the wall and the modular pull-release latch.

In yet a further embodiment of the invention, a storage system is provided comprising the combination of a panel having a plurality of spaced perforation and at least one shelf-bracket to be supported upon the panel, and including a central wall having a receptacle portion for receiving an end edge of a shelf. The shelf-bracket includes an upper panel-catch and a lower panel-catch that each project outwardly from an edge of the wall in aligned spaced relation to one another. Each of the upper panel-catch and the lower panel-catch have a lock-tab projecting toward an outer edge of the wall. A socket is defined adjacent to the lower panel-catch by a recessed portion of the wall. A modular pull-release latch is positioned within the socket, and includes a cantilevered beam having a tab hat projects outwardly from a free end so as to engage a portion of the perforated panel adjacent to the lower panel-catch. A trigger is disposed within a void defined by the recessed portion of the wall and the modular pull-release latch.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
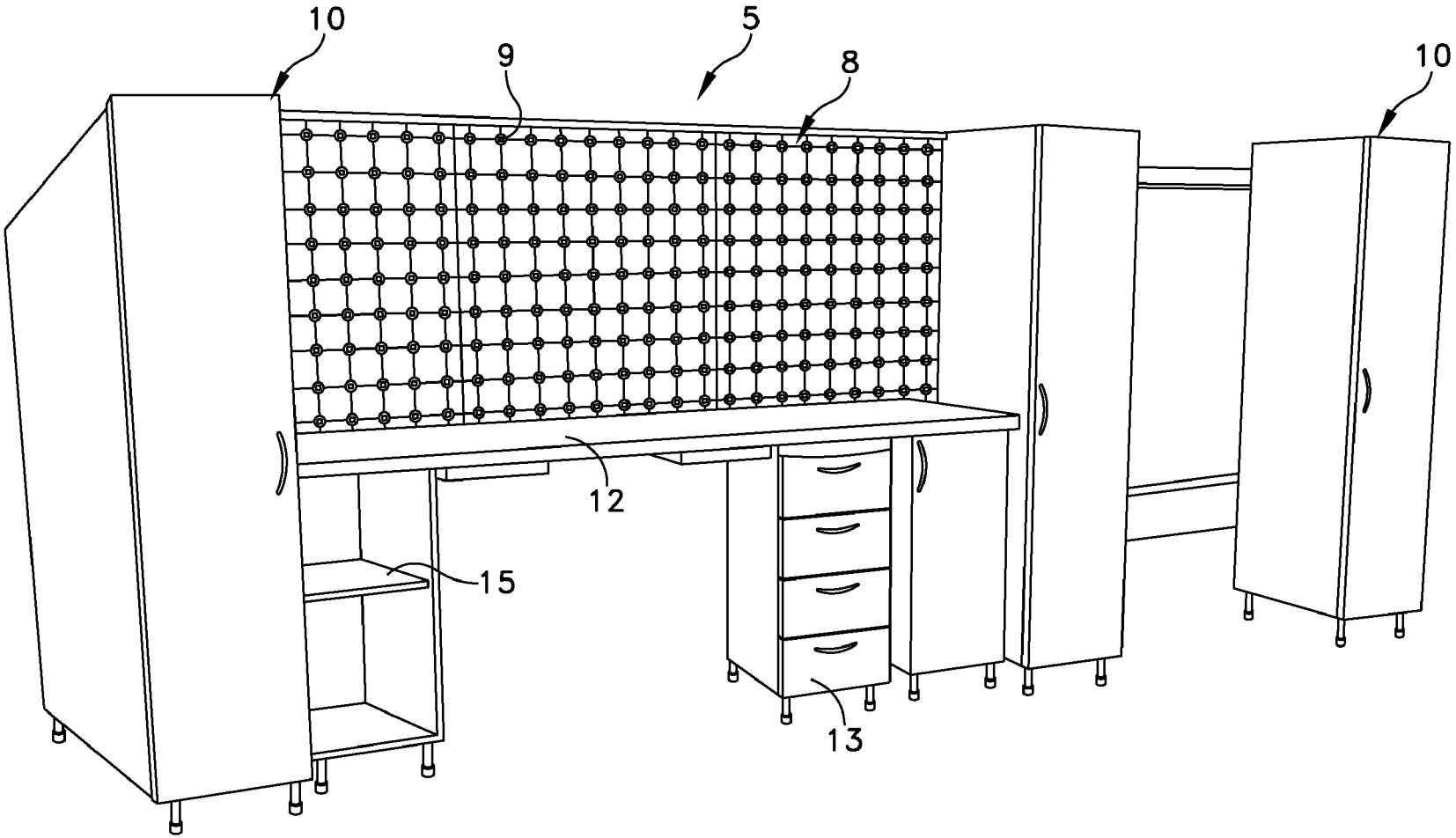
FIG. 1 is a perspective view of a storage system formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. When only a single machine is illustrated, the term "machine" shall also be taken to include any collection of machines that individually or jointly execute a set (or multiple sets) of instructions to perform any one or more of the methodologies discussed herein. In the claims, means-plus-function clauses, if used, are intended to cover the structures described, suggested, or rendered obvious by the written description or drawings for performing the recited function, including not only structural equivalents but also equivalent structures.

Figure 2:
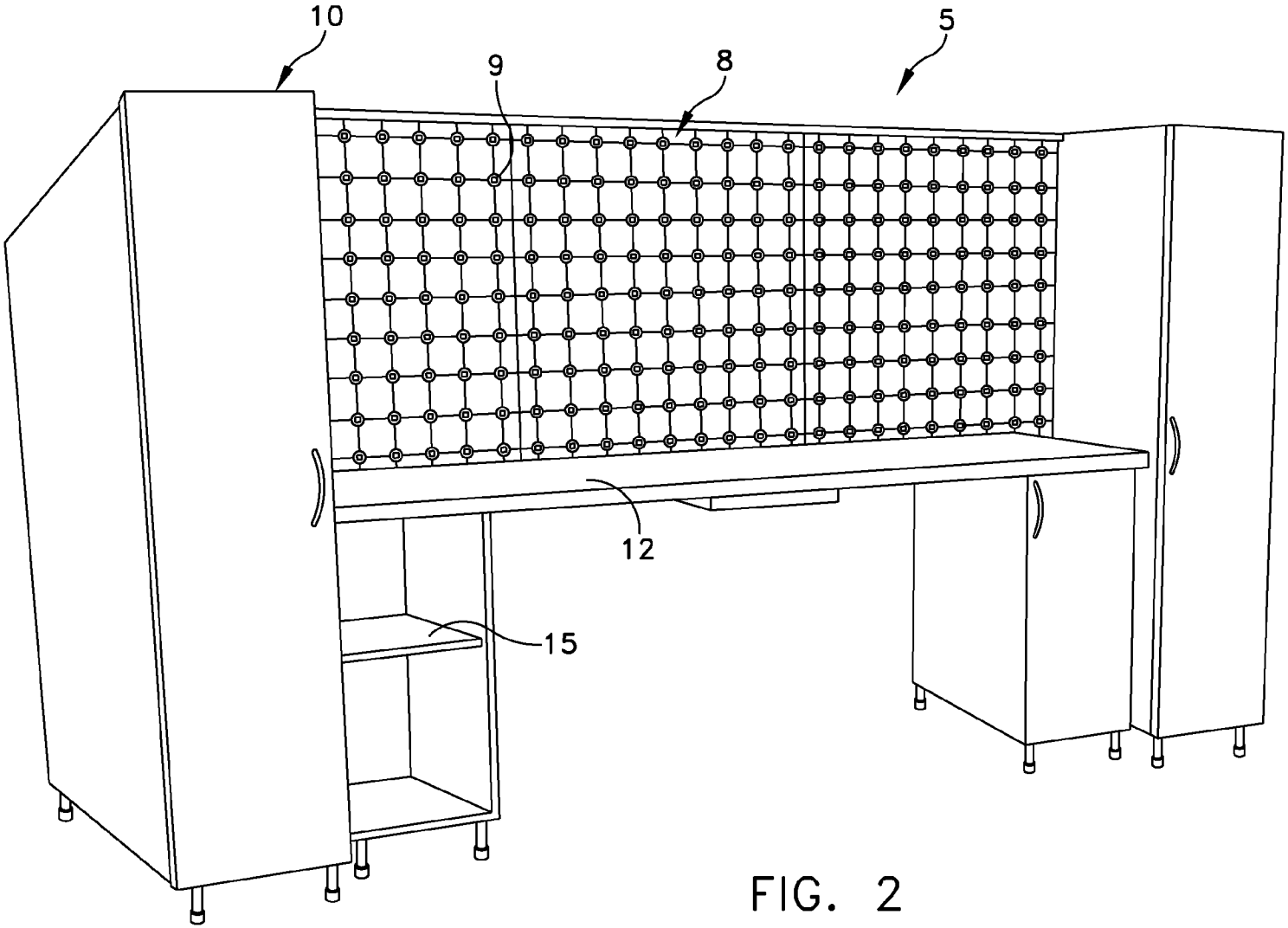
FIG. 2 is a further embodiment of the storage system shown in FIG. 1.
Figure 3:
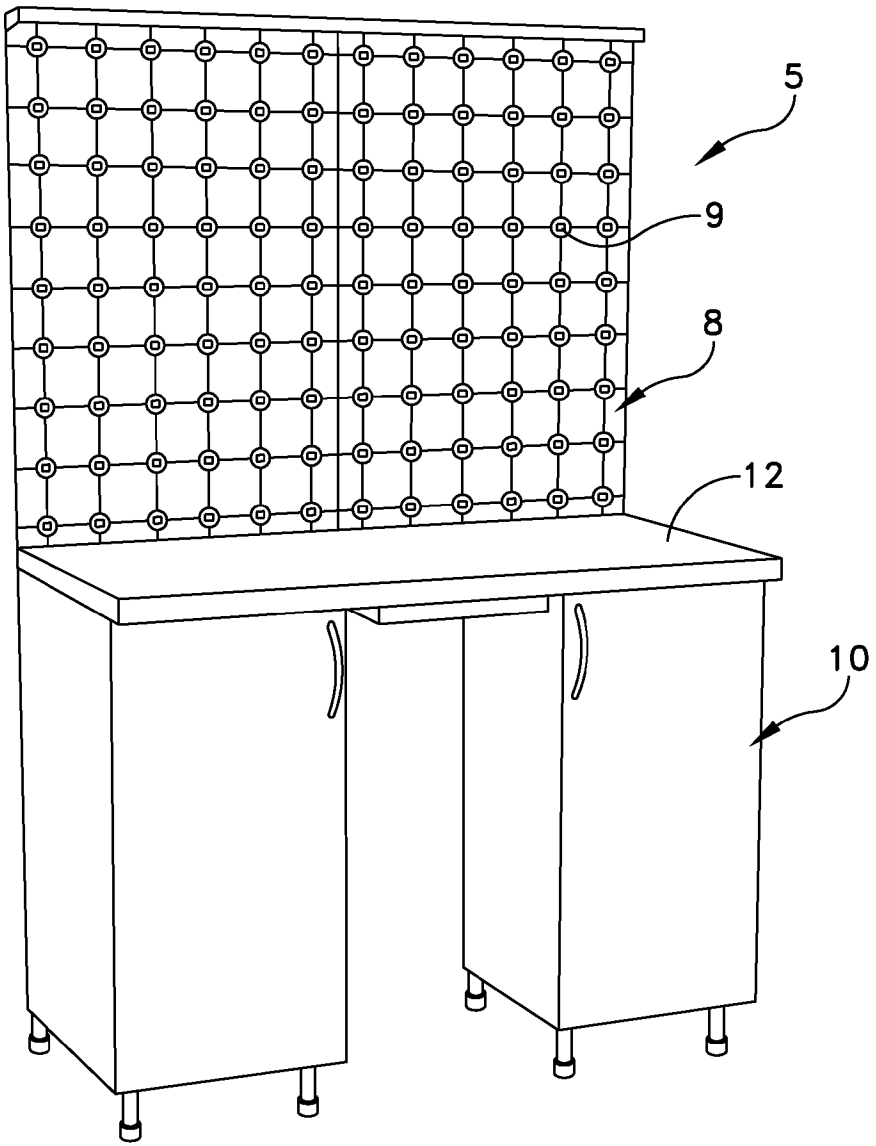
FIG. 3 is another variation of the storage system shown in FIGS. 1 and 2.
Figure 4:
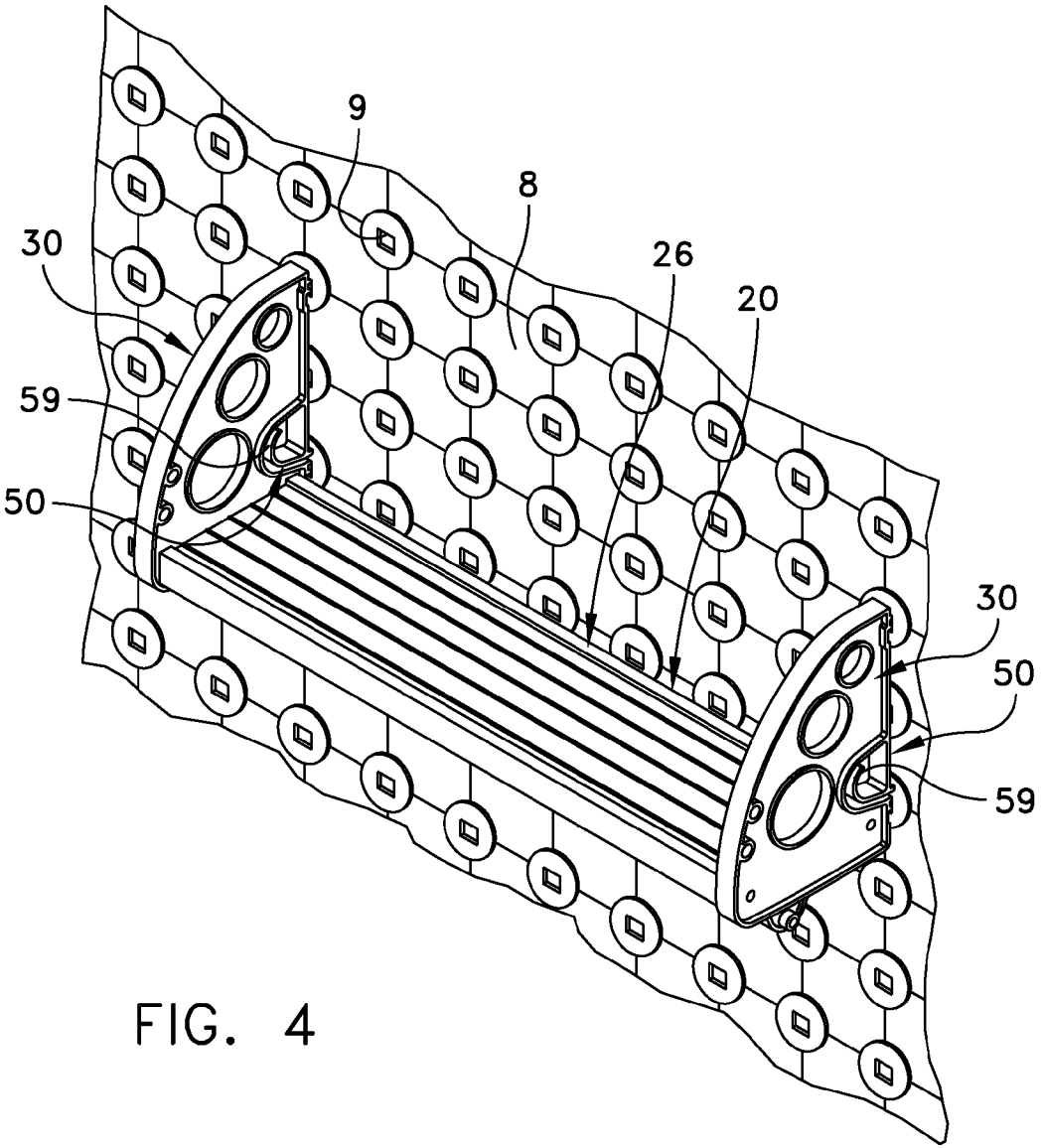
FIG. 4 is a broken-away, perspective view of a perforated panel and item holder formed in accordance with the present invention.

Referring to FIGS. 1-3, the present invention is often used in connection with an improved storage and organization system 5 comprising a perforated panel 8, storage cabinets 10, bench 12, drawers 13, and shelves 15. Storage system 5 is modular in construction such that various combinations of shelves, drawers, and cabinets may be arranged as needed or dictated by its position within a building, e.g., a residential garage, tool shed, or basement area. Storage cabinets 10, bench 12, drawers 13, and shelves 15 are typically formed of common furniture construction materials, e.g., various metals, woods, or polymers. Perforated panel 8 comprises a planer sheet of material, preferably formed of metal, and having a plurality of regularly shaped perforations 9, disposed in a regular pattern throughout the panel. Perforations 9 are each preferably formed in perforated panel 8 so as to be defined by a circumferential edge, often forming a rectangular or square opening in panel 8. Perforated panel 8 is typically about one quarter to one half of an inch thick, and provided in modules that are often about two to three feet wide. Of course, it will be understood that perforated panel 8 may have various lengths and widths, depending upon the size of storage system 5 or, perforated panel 8 may be used alone as a wall hung storage panel.

Often, perforated panel 8 is arranged above bench 12 so that a plurality of item holders 20 may be positioned on the front surface of perforated panel 8. For convenience, in this specification, the term "item holder" will be used to represent a type of fixture that is attachable to perforated panel 8 by insertion of an element into at least one of perforations 9 and used to hold various implements, i.e., hand tools, garden tools, instruments, wires, cables, display objects (such as packages, blister display packs, vacuum display packs, loose hardware or household items, grocery items, department or variety store items, and shelves, pictures, wire frames, and the like. In one preferred embodiment, item holder 20 comprises a shelf 26 held to perforated panel 8, via shelf-brackets 30.

Figure 5:
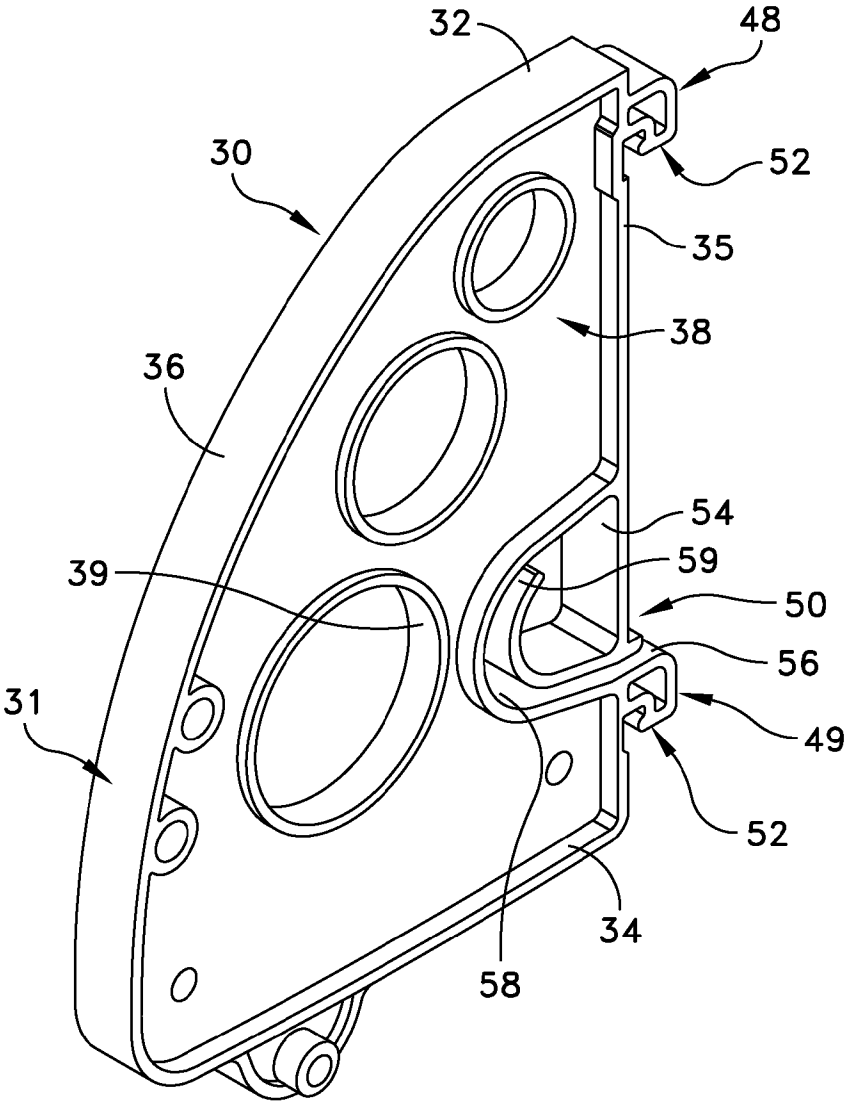
FIG. 5 is a perspective view of a novel item holder formed in accordance with the present invention.
Figure 6:
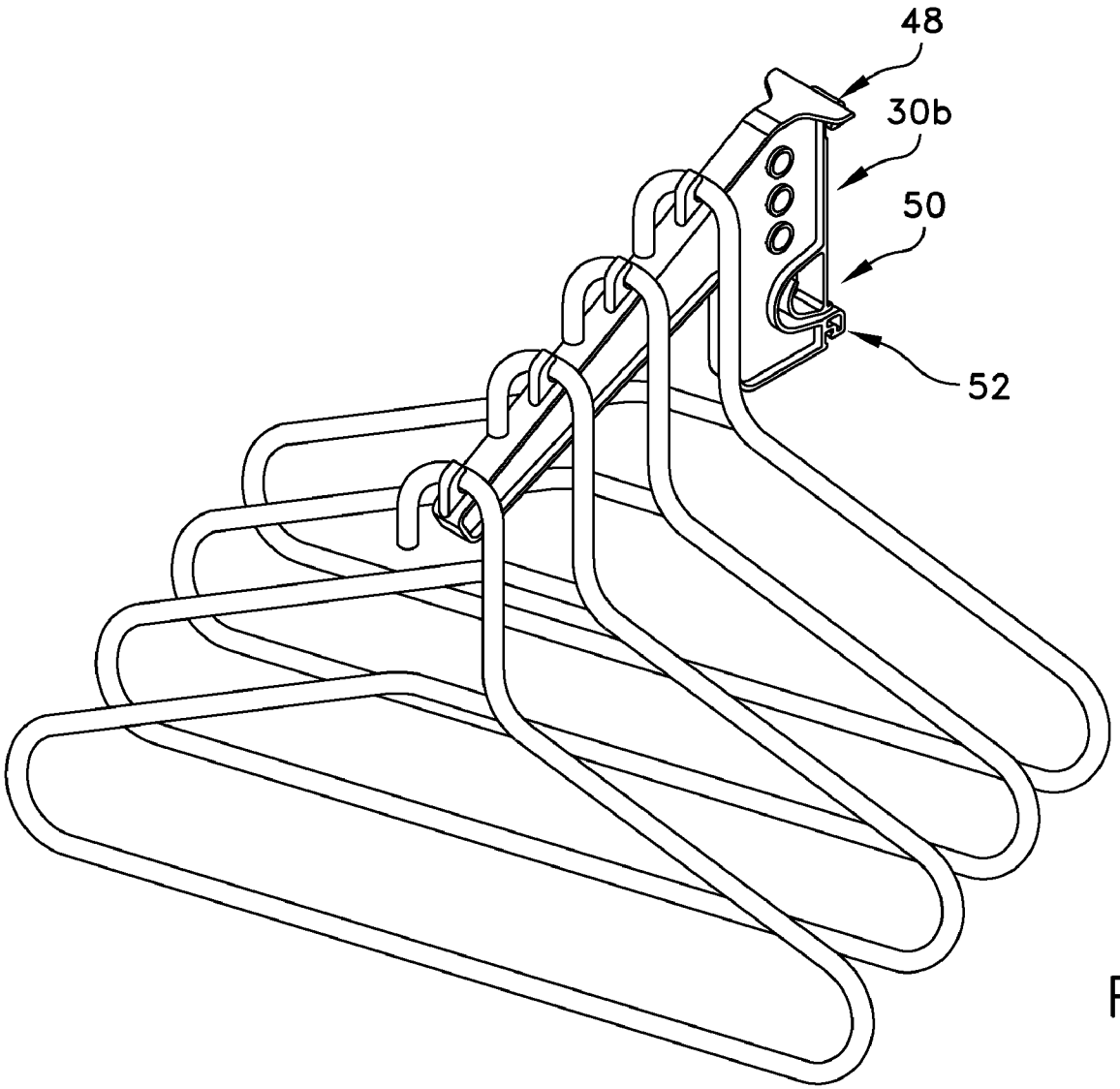
FIG. 6 is a perspective view of a novel item holder formed as a shelf-bracket in accordance with the present invention.
Figure 7:
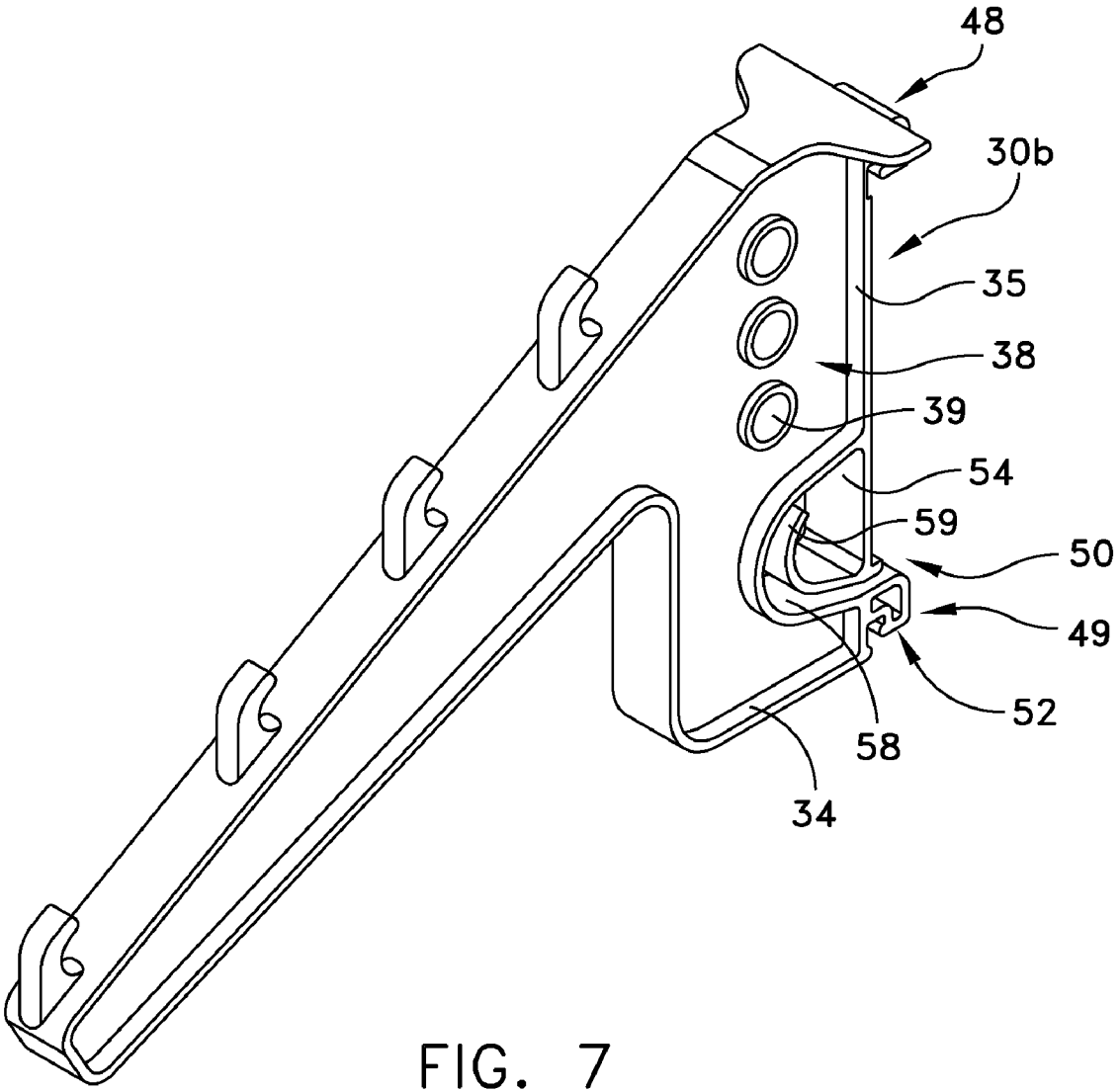
FIG. 7 is a perspective view of the shelf-bracket shown in FIG. 6, with the cloths hangars removed for clarity of illustration.
Figure 9:
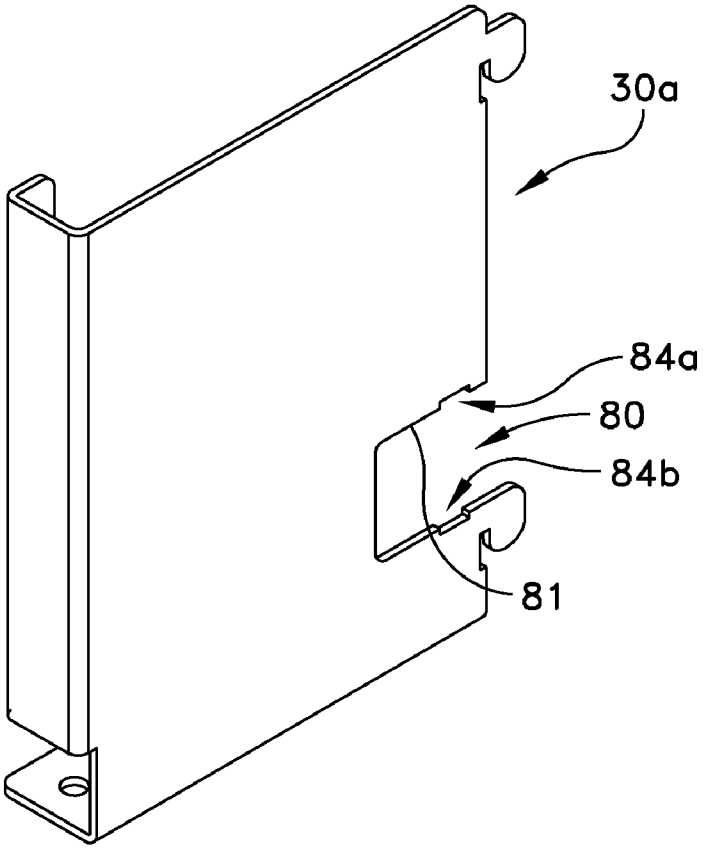
FIGS. 8 and 9 are perspective, left and right rear views of another item holder formed as a shelf-bracket in accordance with the present invention.
Figure 8:
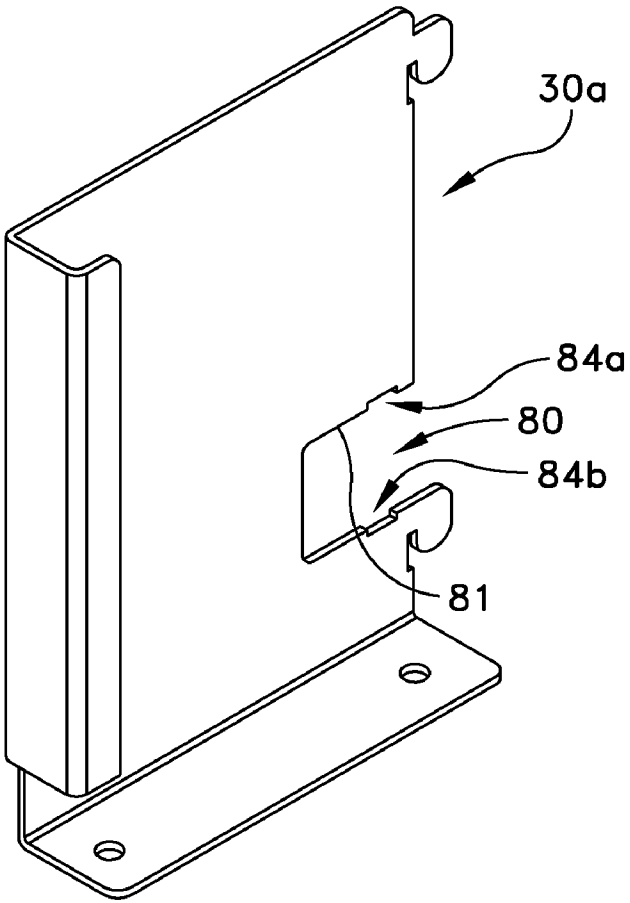
Figure 11:
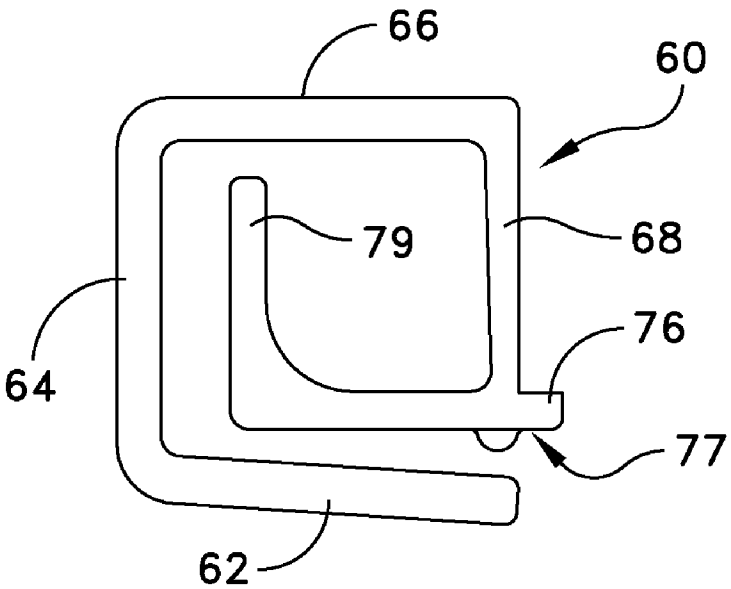
FIG. 11 is a side elevational view of the modular pull-release latch shown in FIG. 10.
Figure 10:
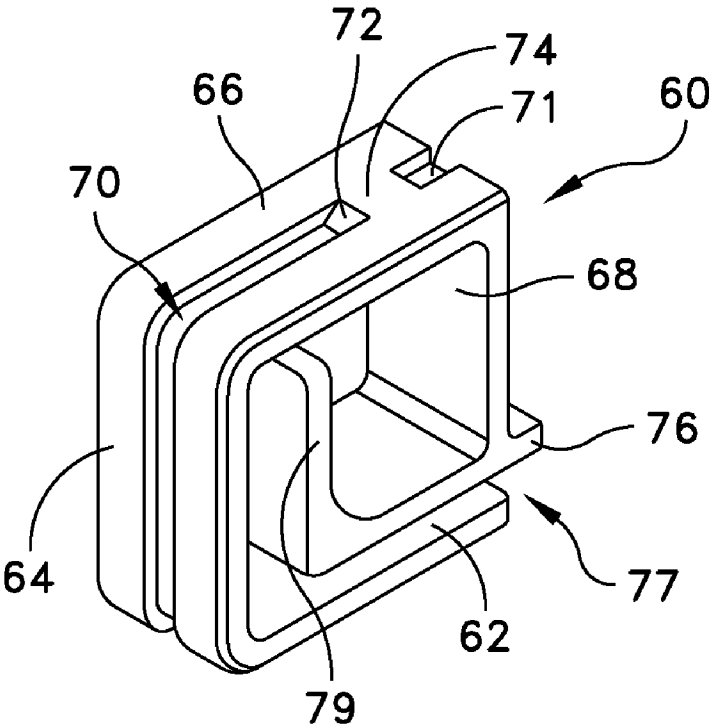
FIG. 10 is a perspective view of a modular pull-release latch formed in accordance with the present invention.

Referring to FIGS. 4-7, one embodiment of shelf-bracket 30 comprises a circumferential flange 31 having a top surface 32, an outward face 36, a bottom 34, and an inner wall 35 (FIG. 5). A lower web 38 is positioned between outward face 36, bottom 34, and inner wall 35. Shelf-brackets 30 are preferably formed from an injection moldable polymer, but may also be formed from a sheet of metal or other material as desired, e.g., shelf-bracket 30*a* in FIGS. 8 and 9 are often formed as metal stampings while cloths-brackets 30*b* in FIGS. 6 and 7 are often a molded a polymer. A plurality of openings 39 are defined through lower web 38, often having varying diameters. An upper panel-catch 48 and a lower panel-catch 49 project outwardly from the outer surface of inner wall 35. Each of upper panel-catch 48 and lower panel-catch 49 comprise a substantially "hook" shape portion having a lock-tab 52 projecting toward the outer surface of inner wall 35. Adjacent to lower panel-catch 49 is a pull-release latch 50, including a pull-release cantilever 54 that projects from an end of inner wall 35. A pull-release tab 56 is positioned at the free end of pull-release cantilever 54. A recessed wall 58 is positioned in spaced relation to pull-release cantilever 54, so as to provide a recess within shelf-bracket 30 into which pull-release cantilever 54 may deflect. A trigger 59 is disposed within the void defined by recessed wall 58 so as to be accessible by a finger or other actuator. Of course, a variety of item holders 20*a* may be formed in a similar manner to shelf-bracket 30 and incorporating the structures associated with pull-release latch 50 (FIGS. 6 and 7).

An item holder 20 may be positioned anywhere on perforated panel 8 in the following manner. Each panel-catch 48,49 of each shelf-bracket 30 is positioned in coaxial aligned relation with a corresponding set of four perforations 9 in perforated panel 8. In this position, lock-release tab 56 is positioned in confronting relation to the front surface of perforated panel 8, directly above the perforation 9 with which its corresponding lower panel-catch 49 is aligned. Once in this position, item holder 20 is moved toward perforated panel 8 until upper panel-catches 48 enter, pass through, and occupy their respective perforation 9. As this occurs, lower panel-catches 49 enter, pass through, and occupy their respective perforations 9. At the same time, lock-release tab 56 engages the front surface of perforated panel 8 directly adjacent to the perforation 9 that is occupied by lower panel-catch 49. Item holder 20 is then moved toward perforated panel 8 until the outer surface of inner wall 35 engages the outer surface of perforated panel 8. In this position, panel-catches 48 and 49 are fully inserted within perforations 9, and pull-release latch 50 is deflected inwardly, toward recessed wall 58 of shelf-bracket 30. Item holder 20 is then moved downwardly, so that lock-tabs 52 move across the edge of perforated panel 8 that defines perforation 9, and into engagement with the rear surface of perforated panel 8. As this occurs, lock-release tab 56 of pull-release latch 50 slides along the front surface of perforated panel 8, and across the peripheral edge of perforation 9 into which lower panel-catch 49 has been previously inserted. Also, pull-release cantilever 54 is released so as to move outwardly, away from recessed wall 58, such that lock-release tab 56 slides along the edge of perforated panel 8 that defines perforation 9, so as to secure shelf-bracket 30 in locked engagement with perforated panel 8.

In order to remove item holder 20, it is necessary only to pull trigger 59 of pull-release cantilever 54 inwardly, toward recessed wall 58 and move item holder 20 upwardly relative to perforated panel 8. In this way, when lock-release tabs 56 disengage from their respective perforations 9, both shelf-brackets 30 may be slid outwardly, disengaging lock tabs 52, so that item holder 20 may be pulled from its position on perforated panel 8.

Referring to FIGS. 10-14, a modular pull-release latch 60 is provided for use in connection with an alternative shelf-bracket 30*a*. Pull-release latch 60 includes a bottom wall 62, a rear wall 64, a top wall 66, and a pull-release cantilever 68. Pull-release cantilever 68 is arranged in spaced relation to rear wall 64 so as to define a void between bottom wall 62, rear wall 64, top wall 66, and pull-release cantilever 68. Each of bottom wall 62 and rear wall 64 define a central recessed groove 70. Recessed groove 70 continues along the outer surface of top wall 66 until it reaches ramp 72 on the end of stop 74 where it terminates. A secondary groove 71 extends from stop 74 through the end of top wall 66 and the bottom wall 62. In some embodiments, a stop and secondary groove are also located within a portion of recessed groove 70 within bottom wall 62. Pull-release cantilever 68 projects from an end of top wall 66. An anti-dislodgement tab 76 projects outwardly from the outer surface of pull-release cantilever 68 adjacent to a free end 77. A trigger 79 is disposed within the void defined by bottom wall 62, rear wall 64, and top wall 66 so as to be accessible by a finger or other actuator.

Figure 13:
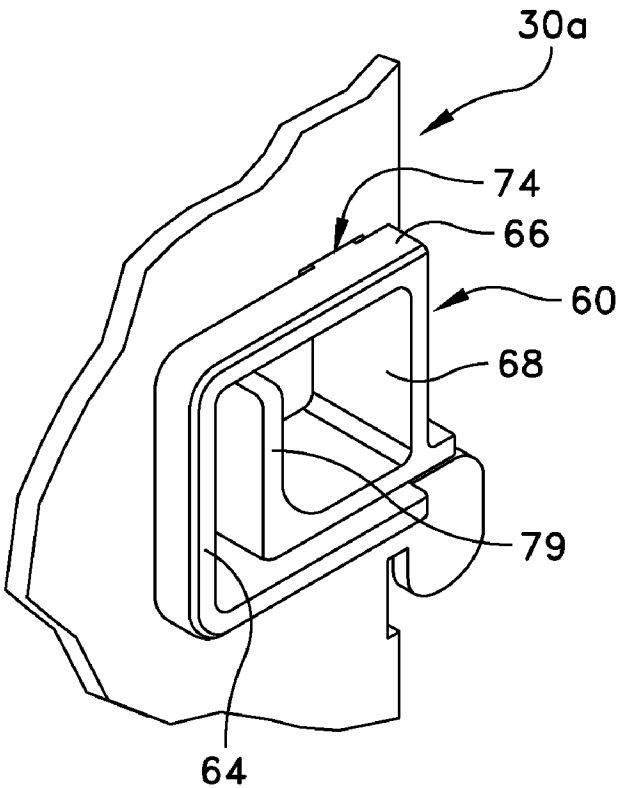
FIG. 13 is a broken-away, perspective view of the modular pull-release latch positioned in its socket in FIG. 12.
Figure 12:
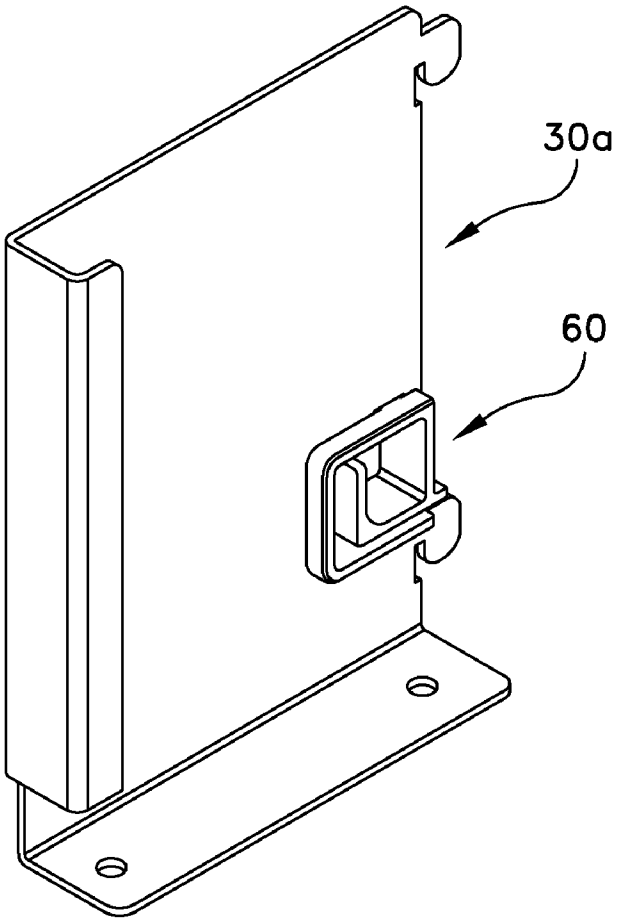
FIG. 12 is a perspective view, similar to FIG. 8, but with a modular pull-release latch positioned in its socket, ready for engagement with a perforated panel.
Figure 14:
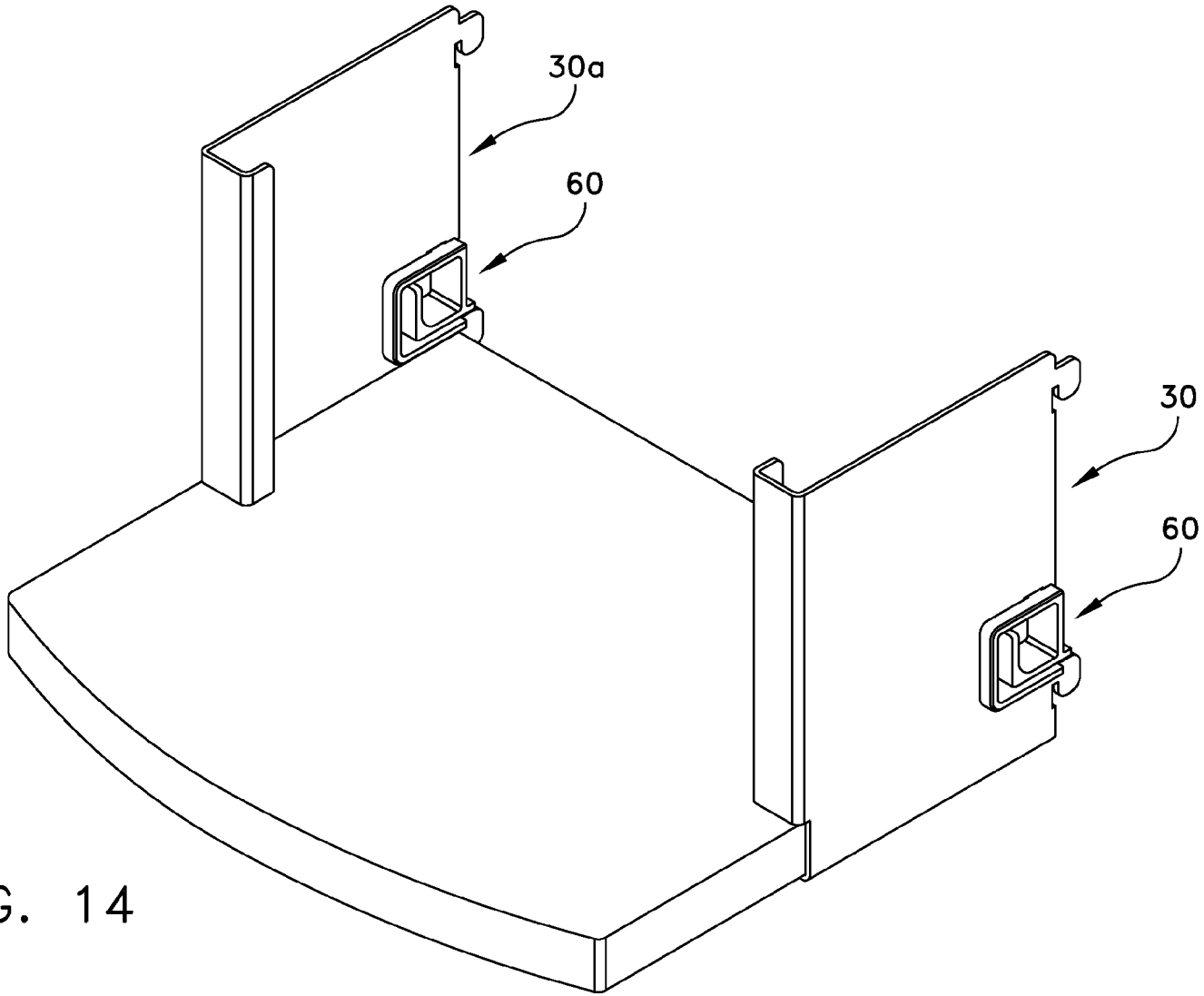
FIG. 14 is a perspective view of a shelf supported by the item holders shown in FIGS. 8 and 9.

In one embodiment of the invention, modular pull-release latch 60 is received in a complementary socket 80 defined by an edge 81 of shelf-bracket 30*a*. Edge 81 also defines confronting receptacle notches 84*a* and 84*b* located within socket 80. Edge 81 has a thickness that is complementary to the width of recessed groove 70 in modular pull-release latch 60. In this way, modular pull-release latch 60 may be arranged in spaced confronting and aligned position from socket 80 such that recessed groove 70 is coaxially aligned with edge 81. From this arrangement, modular pull-release latch 60 is moved toward shelf-bracket 30*a* so that edge 81 is slidingly received within recessed groove 70 until a leading portion of edge 81, adjacent to notches 84*a* and 84*b*, engages ramp 72. Modular pull-release latch 60 continues into socket 80 until stops 74 slip into respective receptacle notches 84*a* and 84*b* thereby locking modular pull-release latch 60 to shelf-bracket 30*a* (FIGS. 12-14). It should be noted that an advantage of the invention lies in the ability to retro-fit a modular pull-release latch 60 in an existing shelf-bracket by simply cutting a socket 80 into the old bracket in accordance with the foregoing structural description so as to form a shelf-bracket 30*a*.

It is to be understood that the present invention is by no means limited only to the particular constructions herein disclosed and shown in the drawings, but also comprises any modifications or equivalents within the scope of the claims.

What is claimed is:

1. A shelf-bracket to be supported upon a panel having a plurality of spaced perforations comprising:

a substantially circumferential flange and a receptacle portion for receiving an end edges of a shelf;

an upper panel-catch and a lower panel-catch projecting outwardly from a side of said circumferential flange in aligned spaced relation to one another, each of said upper panel-catch and said lower panel-catch having a lock-tab projecting toward an outer surface of said circumferential flange; and a pull-release latch comprising a cantilevered beam including a tab projecting outwardly from a free end so as to engage a portion of said perforated panel adjacent to said lower panel-catch, and a trigger disposed within a void defined by a recessed wall, wherein said cantilevered beam is arranged in spaced relation to a recessed wall.

2. A shelf-bracket according to claim 1 wherein said pull-release latch includes a pull-release cantilever that projects from an end of a wall.

3. A shelf-bracket according to claim 2 wherein a pull-release tab is positioned at a free end of said pull-release cantilever.

4. A shelf-bracket according to claim 3 wherein a recessed wall of said shelf-bracket is positioned in spaced relation to said pull-release cantilever, so as to provide a recess into which pull-release cantilever may deflect.

5. A shelf-bracket according to claim 4 wherein said trigger is disposed within the void defined by said recessed wall so as to be accessible by a finger or other actuator.

6. A shelf-bracket to be supported upon a panel having a plurality of spaced perforations comprising:

a central wall having a receptacle portion for receiving an end edge of a shelf;

an upper panel-catch and a lower panel-catch projecting outwardly from an edge of said wall in aligned spaced relation to one another, each of said upper panel-catch and said lower panel-catch having a lock-tab projecting toward an outer edge of said wall, and further wherein a socket is defined adjacent to said lower panel-catch by said recessed portion of said wall; and a modular pull-release latch positioned within said socket, and comprising a cantilevered beam including a tab projecting outwardly from a free end so as to engage a portion of said perforated panel adjacent to said lower panel-catch, and a trigger disposed within a void defined by said recessed portion of said wall and said modular pull-release latch, wherein said modular pull-release latch includes a bottom wall, a rear wall, and a top wall joined so as to define a void, and a pull-release cantilever arranged in spaced relation to said rear wall.

7. A shelf-bracket according to claim 6 wherein each of said bottom wall and said rear wall define a central recessed groove running along a central portion of an outer surface that is sized to receive a portion of said edge of said wall.

8. A shelf-bracket according to claim 7 wherein said recessed groove continues along said outer surface of said top wall between stops located within said recessed groove on said bottom wall and said top wall.

9. A shelf-bracket according to claim 8 wherein each of said stops includes a ramp located with an adjoin portion of said recessed groove.

10. A shelf-bracket according to claim 9 wherein a secondary groove extends from each stop through an end of said top wall and said bottom wall.

11. A shelf-bracket according to claim 10 wherein said pull-release cantilever projects from an end of said top wall, and includes an anti-dislodgement tab projecting outwardly from an outer surface adjacent to a free end.

12. A shelf-bracket according to dam 11 wherein said trigger is disposed within the void defined by said recessed wall so as to be accessible by a finger or other actuator.

13. A shelf-bracket according to claim 10 wherein said socket is defined by an inner edge of said central wall so as to be complementary with said modular pull-release latch.

14. A shelf-bracket according to claim 13 wherein said inner edge also defines confronting receptacle notches and located within said socket, and wherein said inner edge comprises a thickness that is complementary to said recessed groove.

15. A shelf-bracket according to claim 14 wherein said modular pull-release latch may be arranged within said socket such that said recessed groove receives a portion of said inner edge.

16. A shelf-bracket according to claim 15 wherein said stops are received within notches.

* * * * *